US009861852B2

(12) United States Patent
Quinn et al.

(10) Patent No.: US 9,861,852 B2
(45) Date of Patent: Jan. 9, 2018

(54) GAME SYSTEM HAVING FULL-BODY EXERCISE APPARATUS CONTROLLER WITH INDEPENDENTLY OPERABLE APPENDICULAR MEMBERS

(71) Applicants: Robert Quinn, Itasca, IL (US); Ivan Kiselev, Itasca, IL (US)

(72) Inventors: Robert Quinn, Itasca, IL (US); Ivan Kiselev, Itasca, IL (US)

( * ) Notice: Subject to any disclaimer, the term of this patent is extended or adjusted under 35 U.S.C. 154(b) by 435 days.

(21) Appl. No.: 14/585,103

(22) Filed: Dec. 29, 2014

(65) Prior Publication Data

US 2016/0184702 A1 Jun. 30, 2016

(51) Int. Cl.
*A63F 13/06* (2006.01)
*A63B 21/00* (2006.01)
(Continued)

(52) U.S. Cl.
CPC ..... *A63B 21/4035* (2015.10); *A63B 21/0056* (2013.01); *A63B 21/0059* (2015.10); *A63B 21/00069* (2013.01); *A63B 21/00192* (2013.01); *A63B 21/4029* (2015.10); *A63B 21/4034* (2015.10); *A63B 22/203* (2013.01); *A63B 23/03541* (2013.01); *A63B 23/03583* (2013.01); *A63B 23/0494* (2013.01); *A63B 2024/0065* (2013.01); *A63B 2024/0071* (2013.01); *A63B 2024/0078* (2013.01); *A63B 2024/0081* (2013.01); *A63B 2024/0093* (2013.01); *A63B 2071/0655* (2013.01); *A63B 2208/0233* (2013.01); *A63B 2210/02* (2013.01);
(Continued)

(58) Field of Classification Search
USPC ..... 463/36
See application file for complete search history.

(56) References Cited

U.S. PATENT DOCUMENTS 5,816,372 A 10/1998 Carlson et al.
RE36,031 E 1/1999 Piaget et al.
(Continued)

OTHER PUBLICATIONS

Ahmadkhanlou, Farzad "Design, Modeling and Control of Magnetorheological Fluid-Based Force Feedback Dampers for Telerobotic Systems" (2008).
(Continued)

*Primary Examiner* — Pierre E Elisca
(74) *Attorney, Agent, or Firm* — Robert B. Polit

(57) ABSTRACT

A game system is disclosed that comprises a game processor configured to control game play of an electronic video game, and a game controller in electronic communication with the game processor. The game controller includes a plurality of appendicular members configured for respective engagement with legs and arms of a user, and a resistance control system providing a resistive force on each of the plurality of appendicular members with respect to movement of the legs and arms of the user. The resistive force provided by the resistance control system is adjustable in a generally continuous manner in response to the game play of the electronic video game. The game controller also includes a feedback control system responsive to at least one of a motion parameter, a force parameter, and/or a position parameter of each of the plurality of appendicular members to control the game play of the electronic video game.

16 Claims, 16 Drawing Sheets

(51) Int. Cl.

| | |
|---|---|
| ***A63B 21/005*** | (2006.01) |
| ***A63B 22/20*** | (2006.01) |
| ***A63B 23/035*** | (2006.01) |
| ***A63B 23/04*** | (2006.01) |
| *A63B 24/00* | (2006.01) |
| *A63B 71/06* | (2006.01) |

(52) U.S. Cl.
CPC ..... *A63B 2210/50* (2013.01); *A63B 2220/16* (2013.01); *A63B 2220/51* (2013.01); *A63B 2220/54* (2013.01); *A63B 2220/803* (2013.01); *A63B 2220/805* (2013.01); *A63B 2220/833* (2013.01); *A63B 2225/09* (2013.01)

(56) References Cited

U.S. PATENT DOCUMENTS

| | | | | |
|---|---|---|---|---|
| 5,888,172 | A | 3/1999 | Andrus et al. | |
| 5,890,995 | A | 4/1999 | Bobick et al. | |
| 6,283,859 | B1 | 9/2001 | Carlson et al. | |
| 6,450,922 | B1 | 9/2002 | Henderson et al. | |
| 6,923,723 | B2 | 8/2005 | Goden et al. | |
| 7,113,166 | B1 | 9/2006 | Rosenberg et al. | |
| 7,276,018 | B2 | 10/2007 | Studdard | |
| 7,427,257 | B1 | 9/2008 | Chernet | |
| 7,870,809 | B2 | 1/2011 | Rice | |
| 8,007,412 | B2 | 8/2011 | Lofgren et al. | |
| 8,292,789 | B2 | 10/2012 | Maresh et al. | |
| 8,308,558 | B2 | 11/2012 | Thorner | |
| 8,313,378 | B1 * | 11/2012 | Snyder | A63B 22/18 463/36 |
| 8,333,681 | B2 | 12/2012 | Schmidt | |
| 8,460,104 | B1 * | 6/2013 | Snyder | A63B 22/18 463/36 |
| 8,647,240 | B2 | 2/2014 | Heidecke | |
| 8,932,183 | B2 | 1/2015 | Ishii et al. | |
| 9,272,180 | B2 | 3/2016 | Eschenbach | |
| 9,579,542 | B2 | 2/2017 | Quinn et al. | |
| 9,649,530 | B2 | 5/2017 | Quinn et al. | |
| 2006/0009891 | A1 | 1/2006 | Pawlak et al. | |
| 2007/0197274 | A1 * | 8/2007 | Dugan | A63F 13/52 463/7 |
| 2010/0035726 | A1 | 2/2010 | Fisher et al. | |
| 2010/0267519 | A1 | 10/2010 | Johnson | |
| 2010/0273616 | A1 | 10/2010 | Schneider | |
| 2011/0077129 | A1 | 3/2011 | Martens | |
| 2012/0109025 | A1 | 5/2012 | Weinberg et al. | |
| 2013/0190135 | A1 | 7/2013 | Pryor | |
| 2013/0229272 | A1 | 9/2013 | Elliott | |
| 2014/0194250 | A1 | 7/2014 | Reich et al. | |
| 2015/0065213 | A1 * | 3/2015 | Dugan | A63F 13/52 463/7 |
| 2016/0203361 | A1 * | 7/2016 | Black | G06K 9/00369 382/203 |

OTHER PUBLICATIONS

U.S. Appl. No. 14/585,072, filed Dec. 29, 2014, "Networked Gaming System Having Multiple Full-Body Exercise Controllers".
U.S. Appl. No. 14/585,117, filed Dec. 29, 2014, "Full-Body Exercise System Including a Plurality of Independently Operable Appendicular Members".

* cited by examiner

GAME SYSTEM HAVING FULL-BODY EXERCISE APPARATUS CONTROLLER WITH INDEPENDENTLY OPERABLE APPENDICULAR MEMBERS

BACKGROUND

There are varieties of exercise devices configured to provide substantial physical workouts to a user to maintain and/or increase the user's fitness level. Stepping machines, treadmills, and many cycling machines are principally configured to exercise the lower portion of the body. Other machines, such as elliptical machines, and some rowing machines, provide a full-body workout in that they are configured to exercise the lower portion of the body by applying resistance to, or requiring movement of, one or both legs of the user and to exercise the upper portion of the body by applying resistance to, or requiring movement of one or both of the arms of the user.

Current full-body workout machines are designed to require direct coordination between simultaneous motion of the limbs. For example, elliptical machines are designed so that the motion of each limb is directly dependent on the motion of all other limbs of the user. This dependency is necessary to achieve the desired elliptical motion between the legs and arms of the user. No provision is made for the motion of one limb independent of the movement of all other limbs.

Further, the existing full-body workout machines do not have truly adjustable resistance features. Again, with respect to elliptical machine, the resistance experienced by one leg of the user is the same as the resistance experienced by the other leg of the user. Likewise, the resistance experienced by one arm of the user is the same as the resistance experienced by the other arm of the user. No provision is made for the application of a resistive force to one limb independent of the resistive force experienced by all other limbs.

Exercise on existing full-body exercise apparatus tends to be very repetitive. This repetition can distort perception of the total workout time, making it seem longer than it truly is. To reduce this distortion, gyms often play music and show television near the exercised apparatus. However, these techniques are often not completely successful since they only distract the user from the workout as opposed to making the direct engagement between the user and the exercise machine more enjoyable.

SUMMARY

A game system is disclosed that comprises a game processor configured to control game play of an electronic video game, and a game controller in electronic communication with the game processor. The game controller includes a plurality of appendicular members configured for respective engagement with legs and arms of a user, and a resistance control system providing a resistive force on each of the plurality of appendicular members with respect to movement of the legs and arms of the user. The resistive force provided by the resistance control system is adjustable in a generally continuous manner in response to the game play of the electronic video game. The game controller also includes a feedback control system responsive to at least one of a motion parameter, a force parameter, and/or a position parameter of each of the plurality of appendicular members to control the game play of the electronic video game.

The resistance control system may include one or more smart fluid-based actuators respectively associated with one or more of the plurality of appendicular members. The one or more smart fluid-based actuators are responsive to an electric current for resistance control. The electric current may correspond to resistance control signals generated by the game processor. Further, the one or more smart fluid-based actuators may include a smart fluid selected from an electro-rheological fluid or a magneto-rheological fluid.

DETAILED DESCRIPTION

Figure 1:
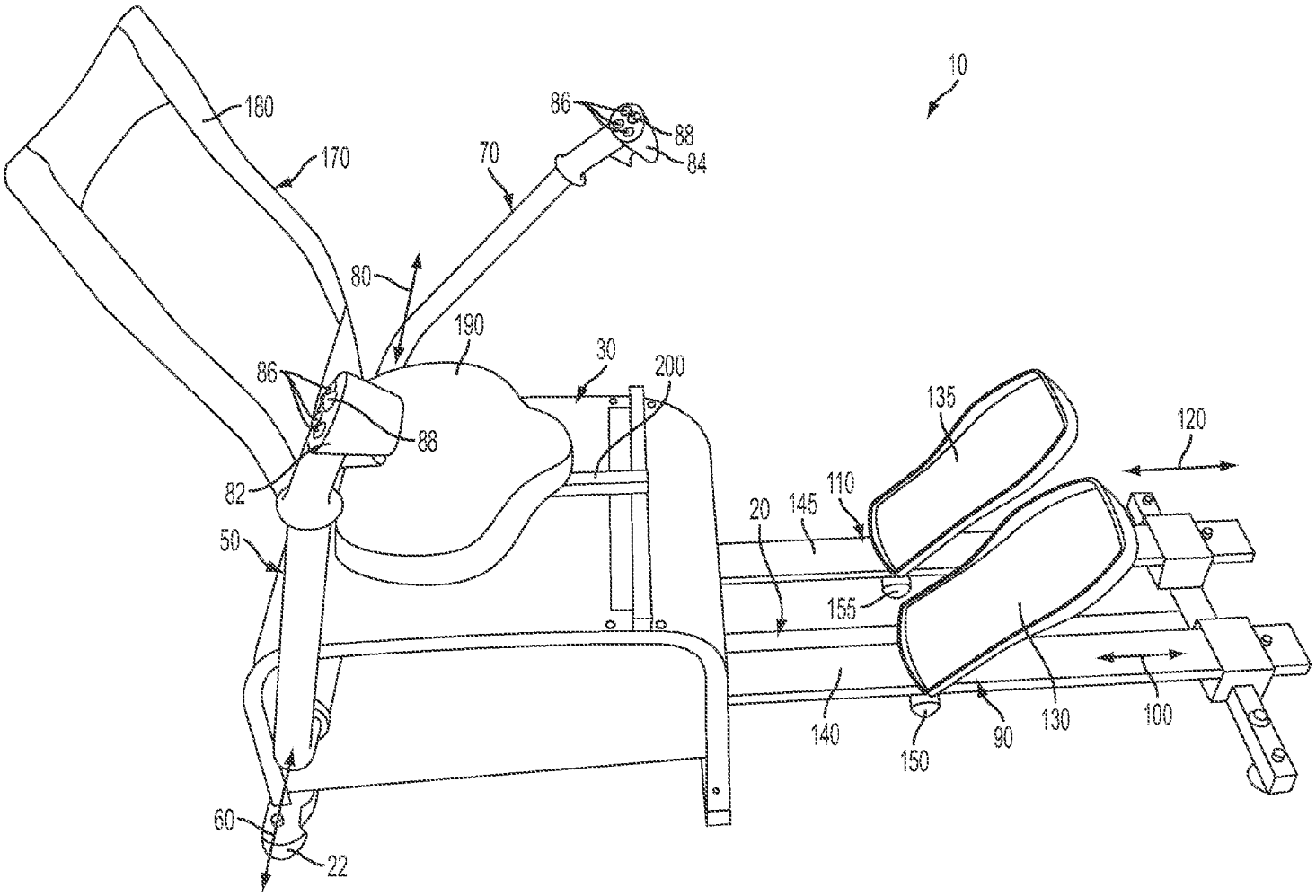
FIG. 1 is a perspective view of one example of a full-body exercise apparatus.

FIG. 1 is a perspective view of one example of the exterior portions of a full-body exercise apparatus 10. As shown, the full-body exercise apparatus 10 includes a frame 20, which is configured to support or be integrated with, various other elements of the full-body exercise apparatus 10. The frame 20 may be in the form of a single integral structure, separate structures that, for example, are in a fixed relationship with one another, or any other structure used to support or integrate with various components of the full-body exercise apparatus 10. The full-body exercise apparatus 10 may also include one or more transport members to facilitate moving it to and from various locations. Here, the transport members are in the form of a plurality of wheels 22 (only one shown in FIG. 1).

In FIG. 1, the frame 20 includes a housing 30, which may partially or completely enclose resistive components of the full-body exercise apparatus 10. Various examples of the resistive components are set forth below.

A plurality of appendicular members extends from the frame and are configured for engagement with a respective limb of the user. Each of the appendicular members is movable in a degree of freedom independent of other ones of the plurality of appendicular members. Here, the plurality of appendicular members include a first appendicular member 50 that is configured for rotation by a first arm of a user about a first pivot axis 60. A second appendicular member 70 is configured for rotation by a second arm of a user about a second pivot axis 80. The first pivot axis 60 and second pivot axis 80 may be generally collinear. In this example, the first appendicular member 50 and second appendicular member 70 are disposed on opposite sides of the housing 30. One or both of the first appendicular member 50 and second appendicular member 70 may terminate at respective handgrips 82 and 84 to engage the hands of the user. As shown, one or both of the handgrips 82 and 84 may include a plurality of buttons 86 and/or mouse-like devices 88 that may be used to implement various functions associated with the full-body exercise apparatus 10.

The full-body exercise apparatus 10 may also include appendicular members used to provide a lower body workout. In FIG. 1, a third appendicular member 90 extends from the frame 20 and is configured to engage a first leg of the user. In this example, the third appendicular member 90 is movable along a first generally linear axis 100. Further, a fourth appendicular member 110 extends from the frame 20 and is configured to engage a second leg of the user. The fourth appendicular member 110 of this example is movable along a second generally linear axis 120. The first generally linear axis 100 and second generally linear axis 120 may be parallel with one another, and disposed horizontally or at an angle with respect to the horizon. The housing 30 may partially or completely enclose resistive elements associated with the third appendicular member 90 and the fourth appendicular member 110.

The third appendicular member 90 and fourth appendicular member 110 are both constructed in a similar manner. To this end, the third appendicular member 90 includes a pedal 130 connected to a sliding member 140 at joint 150. The fourth appendicular member 110 includes a pedal 135 connected to a sliding member 145 by a joint 155. With respect to the fourth appendicular member 110, it includes a pedal 130 connected to a sliding member 140 by a joint 150. The joints 150 and 155 may be fixed or configured for at least partial rotation about respective axes to allow flexion of the ankle of the user. The sliding member 140 is disposed on top of a rail (not shown in FIG. 1) so that the third appendicular member 90 is slidable along the rail in the direction of axis 100. Likewise, the sliding member 145 is disposed on top of a respective rail (not shown in FIG. 1) so that the fourth appendicular member 110 is slidable along the rail in the direction of axis 120.

The user is supported on the full-body exercise apparatus 10 by a seat 170. The seat 170 includes a back portion 180 and a saddle portion 190. The angles at which one or both of the back portion 180 and saddle portion 190 engage the user may be adjustable. Further, the horizontal position of the seat 170 may be adjusted along rail 200 as desired to place the user in a comfortable exercise position.

FIGS. 2-9 illustrate the plurality appendicular members in various positions. As shown in these figures, each appendicular member is movable independent of movement of other ones of the plurality of the appendicular members.

Figure 2:
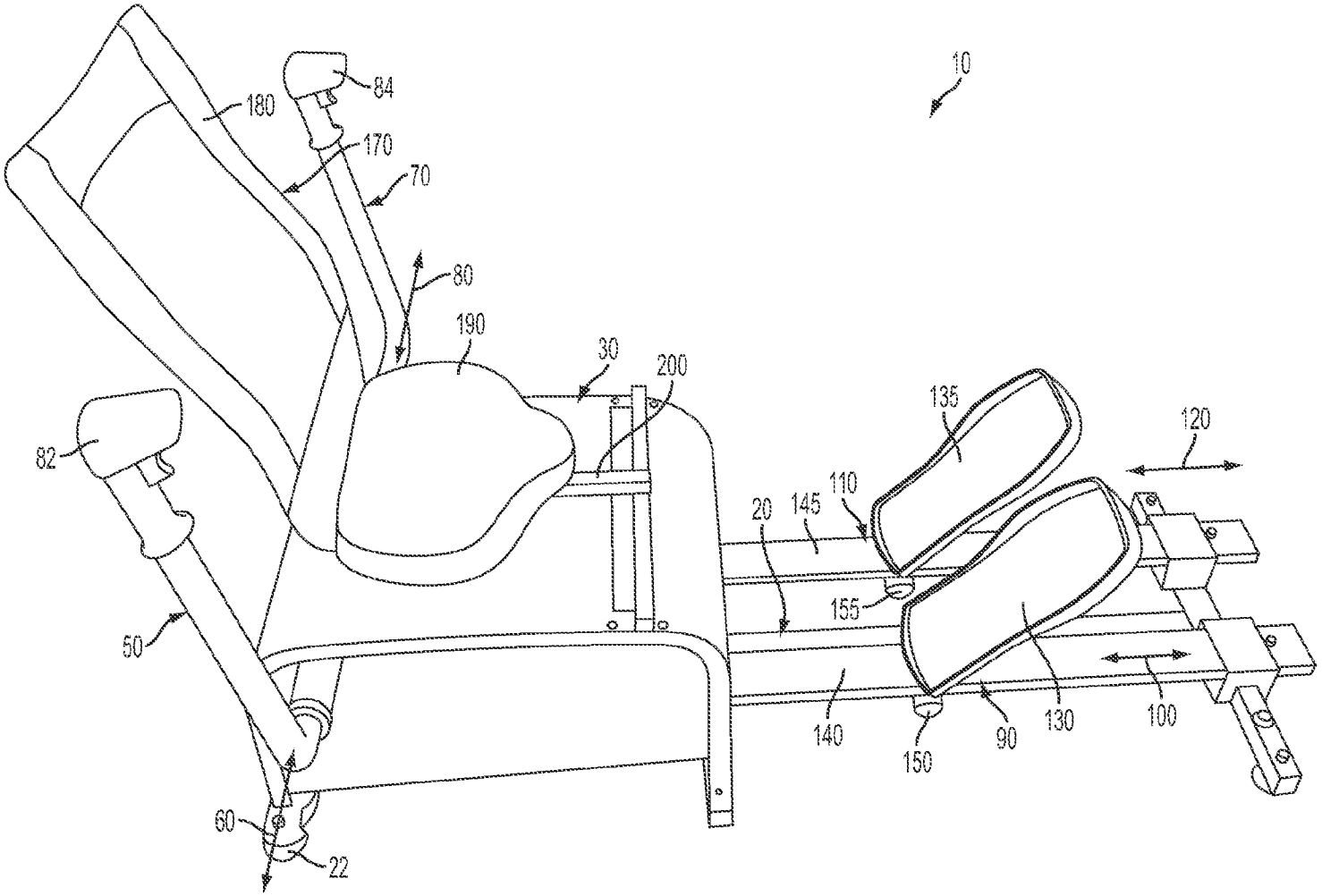
FIG. 2 illustrates the position of the appendicular members associated with the upper body of a user when they are each rotated to a retracted position.
Figure 3:
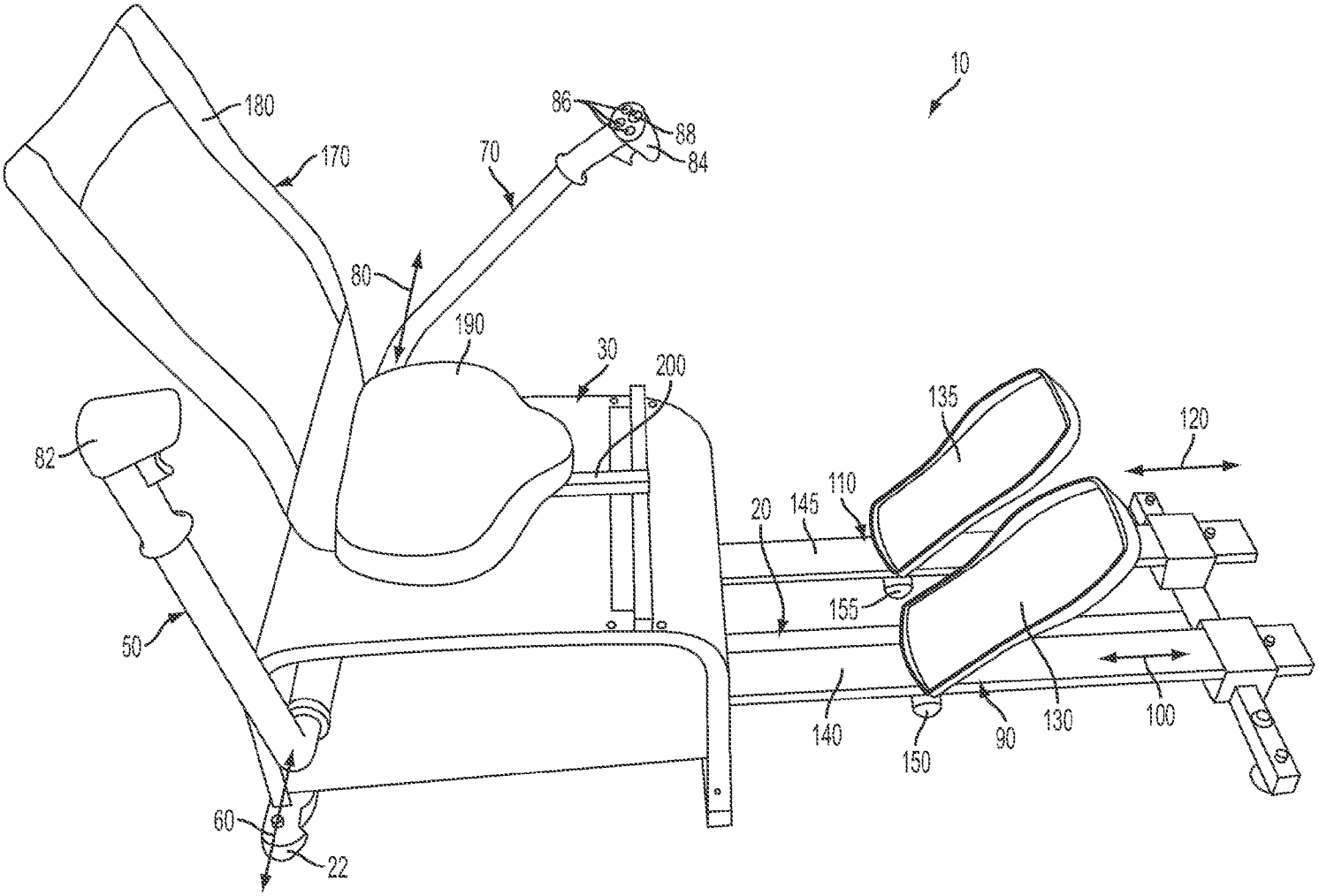
FIG. 3 illustrates the position of the appendicular members associated with the upper body of a user when the right arm is rotated to a refracted position and the left arm is rotated to an extended position.
Figure 4:
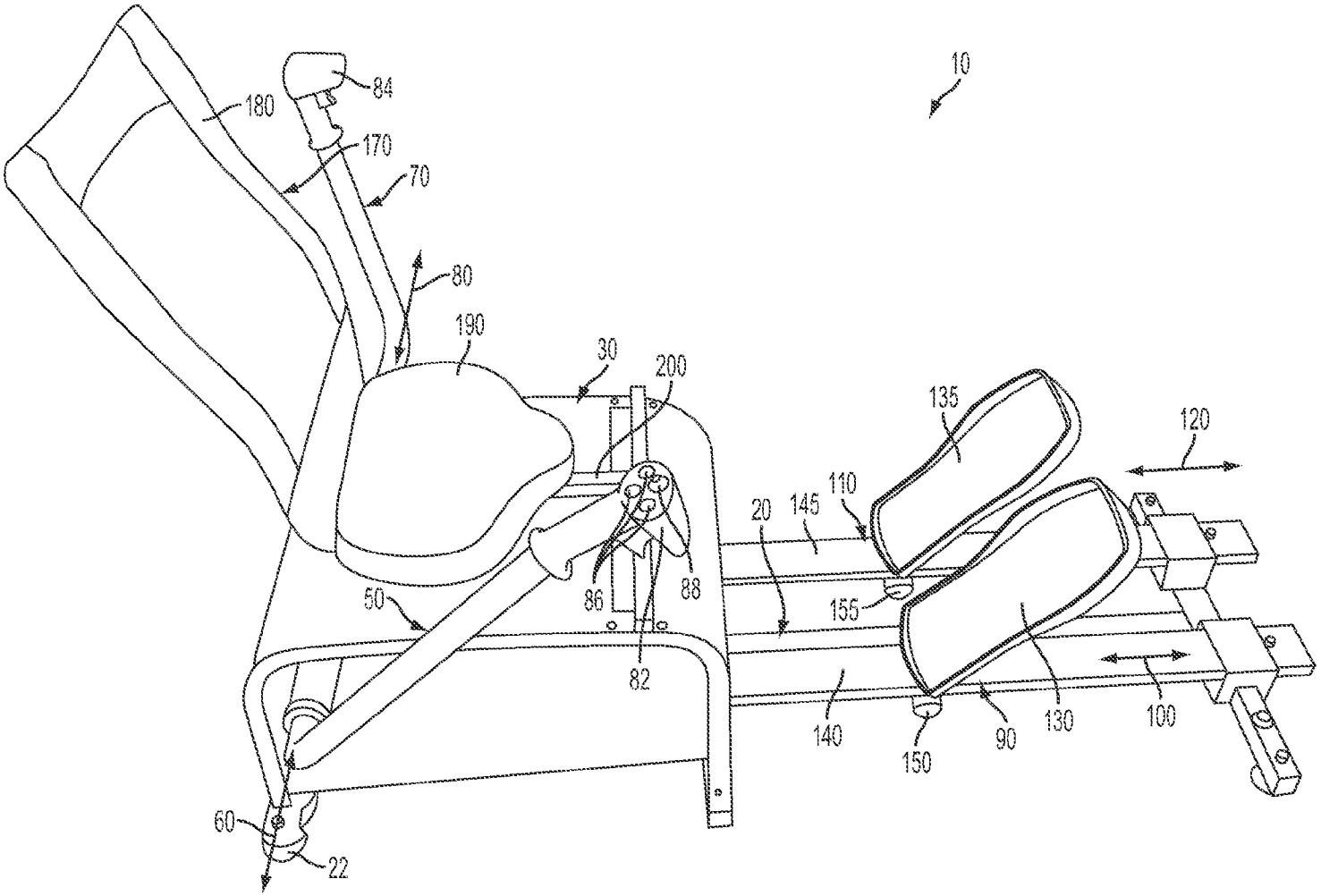
FIG. 4 illustrates the position of the appendicular members associated with the upper body of a user when the left arm is rotated to a retracted position and the right arm is rotated to an extended position.
Figure 5:
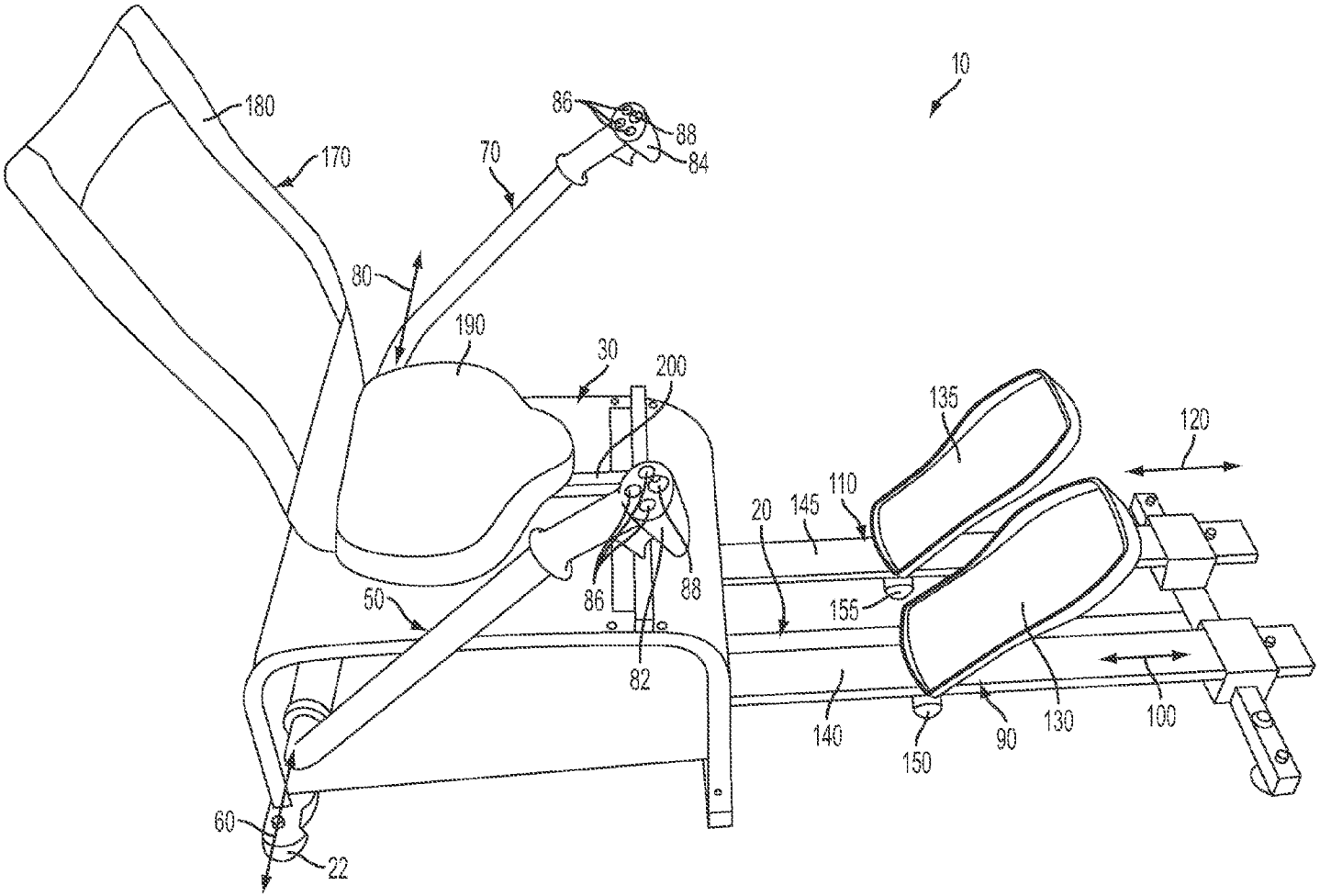
FIG. 5 illustrates the position of the appendicular members associated with the upper body of a user when both arms of the user are rotated to an extended position.

With respect to the appendicular members 50 and 70 associated with the upper body, FIG. 2 illustrates both the appendicular members 50 and 70 in a retracted position. FIG. 3 illustrates the appendicular member 50 for the right arm of the user in a refracted position and the second appendicular member 70 for the left arm rotated to an extended position. FIG. 4 illustrates the second appendicular member 70 for the left arm in a retracted position and the first appendicular member 50 for the right arm rotated to an extended position. FIG. 5 illustrates the first and second appendicular members 50 and 70 both rotated to extended positions.

Figure 6:
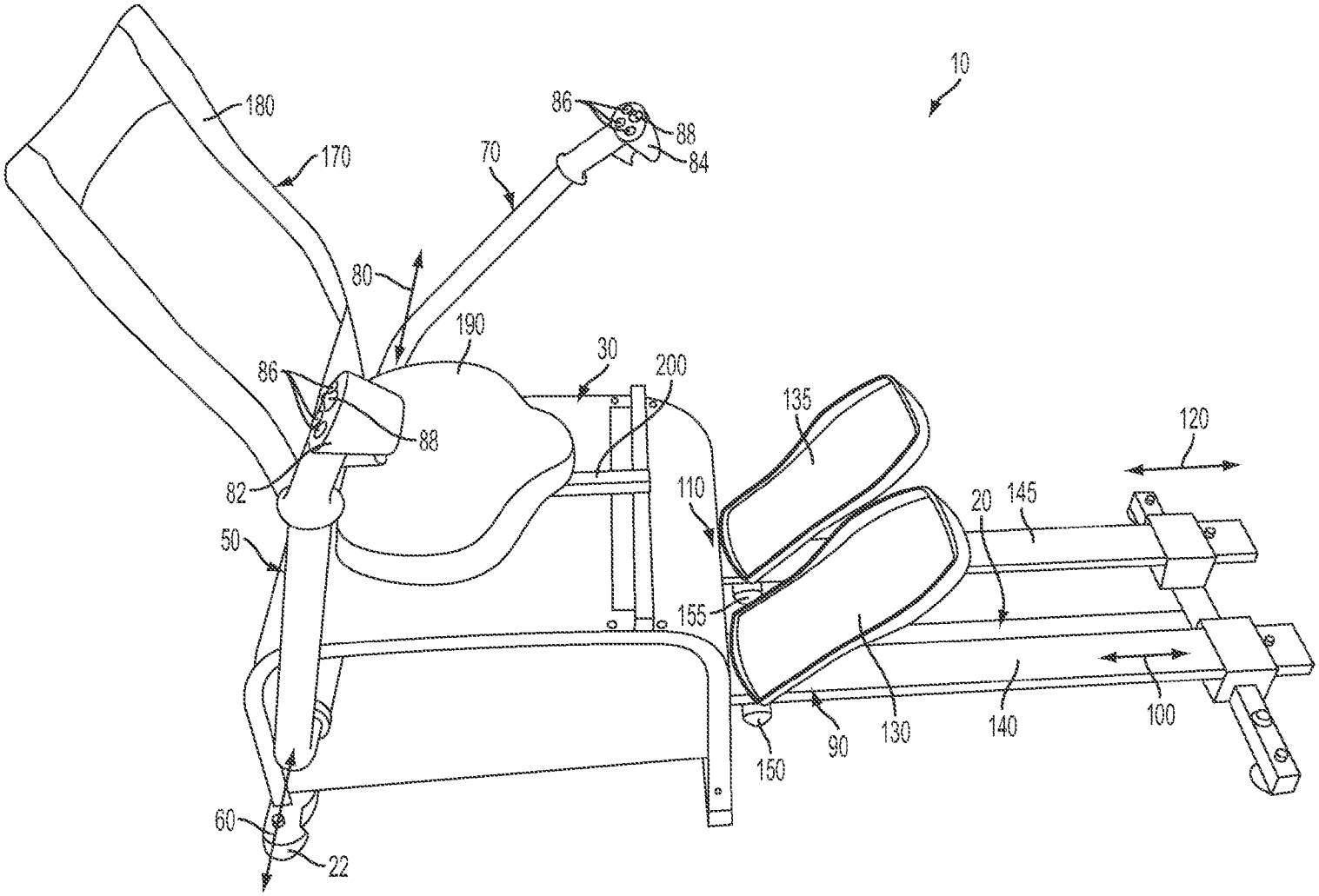
FIG. 6 illustrates the position of the appendicular members associated with the lower body of a user in a retracted position.
Figure 7:
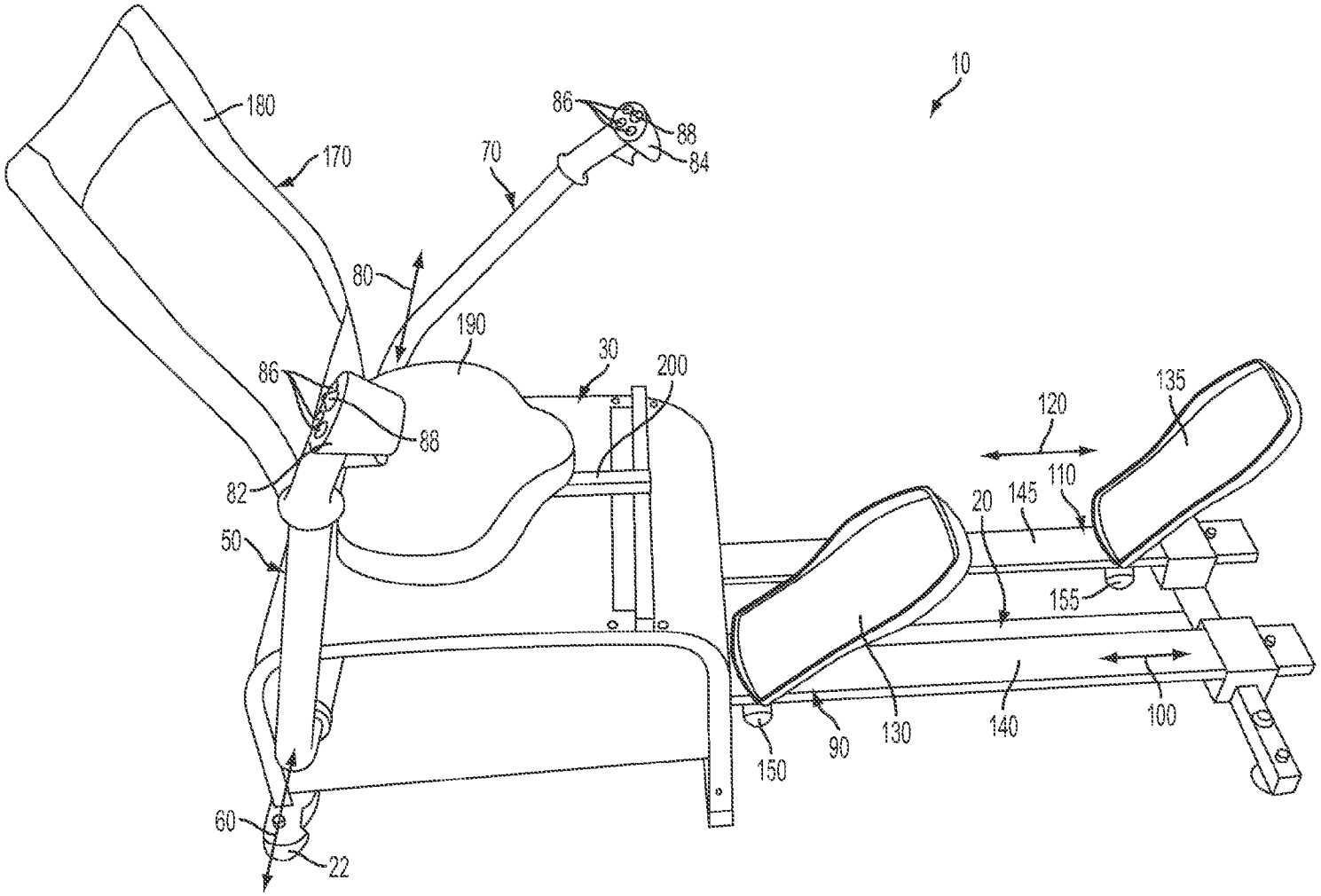
FIG. 7 illustrates the position of the appendicular members associated with the lower body of a user when the right leg is in a retracted position and the left leg is in an extended position.
Figure 8:
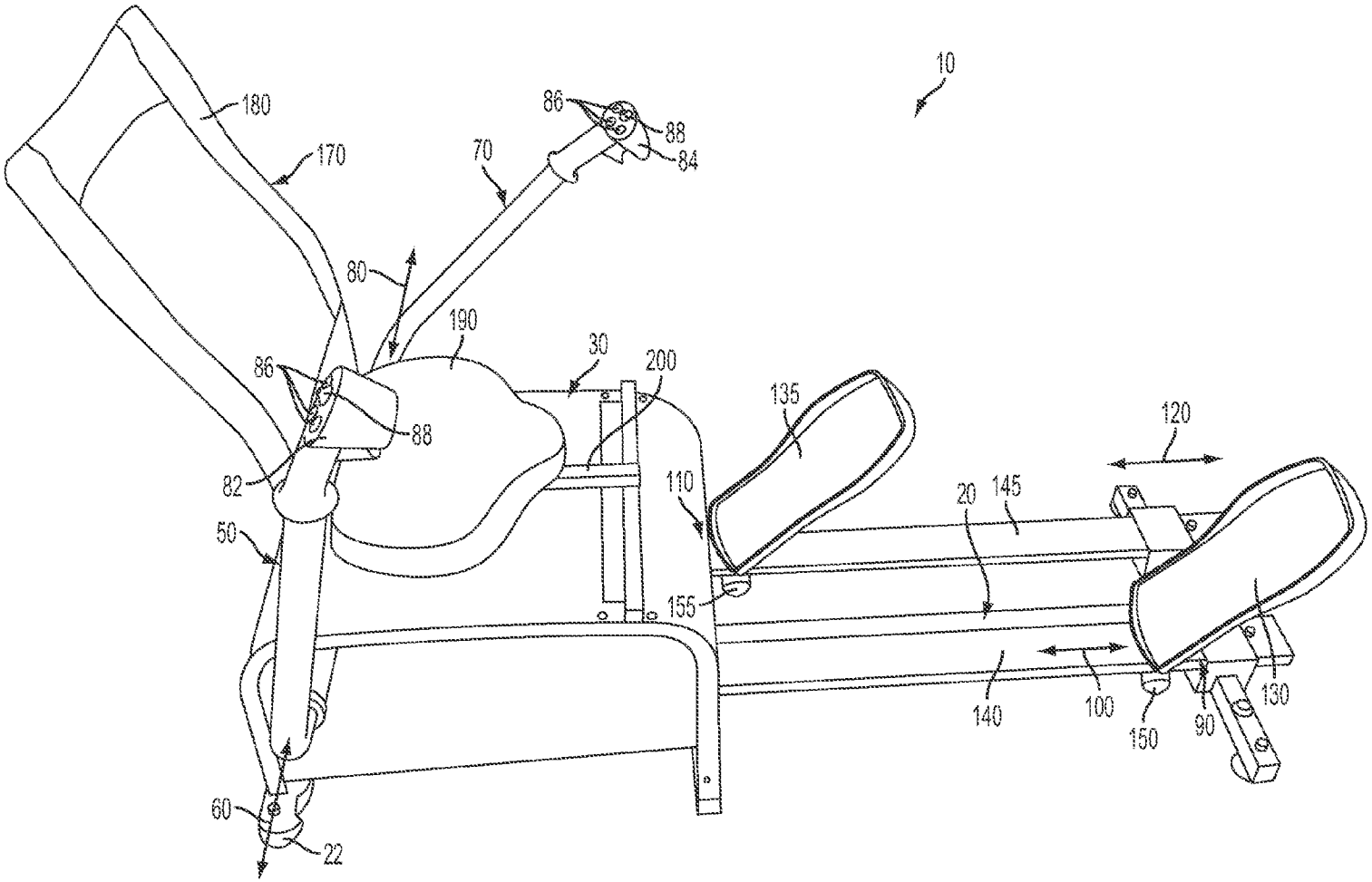
FIG. 8 illustrates the position of the appendicular members associated with the lower body of a user when the left leg is in a retracted position and the right leg is in an extended position.
Figure 9:
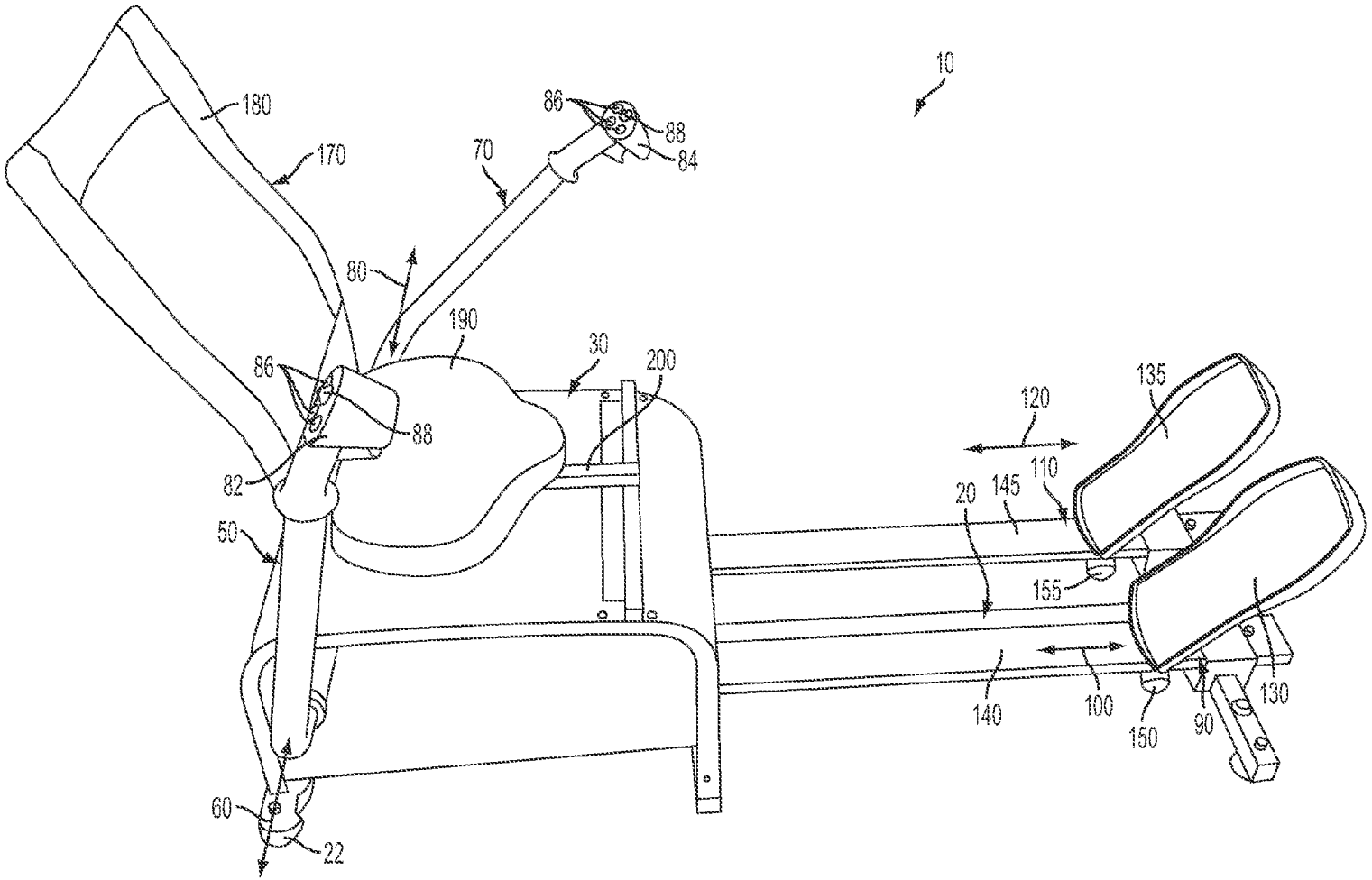
FIG. 9 illustrates the position of the appendicular members associated with the lower body of a user where both legs are in an extended position.

With respect to the third and fourth appendicular members 90 and 110 associated with the lower body, FIG. 6 illustrates the third and fourth appendicular members 90 and 110 in a retracted position. FIG. 7 illustrates the fourth appendicular member 110 in a retracted position and the third appendicular member 90 in an extended position. FIG. 8 illustrates the third appendicular member 90 in a refracted position and the fourth appendicular member 110 in an extended position. FIG. 9 illustrates both the third and fourth appendicular members 90 and 110 in an extended position.

Figure 10:
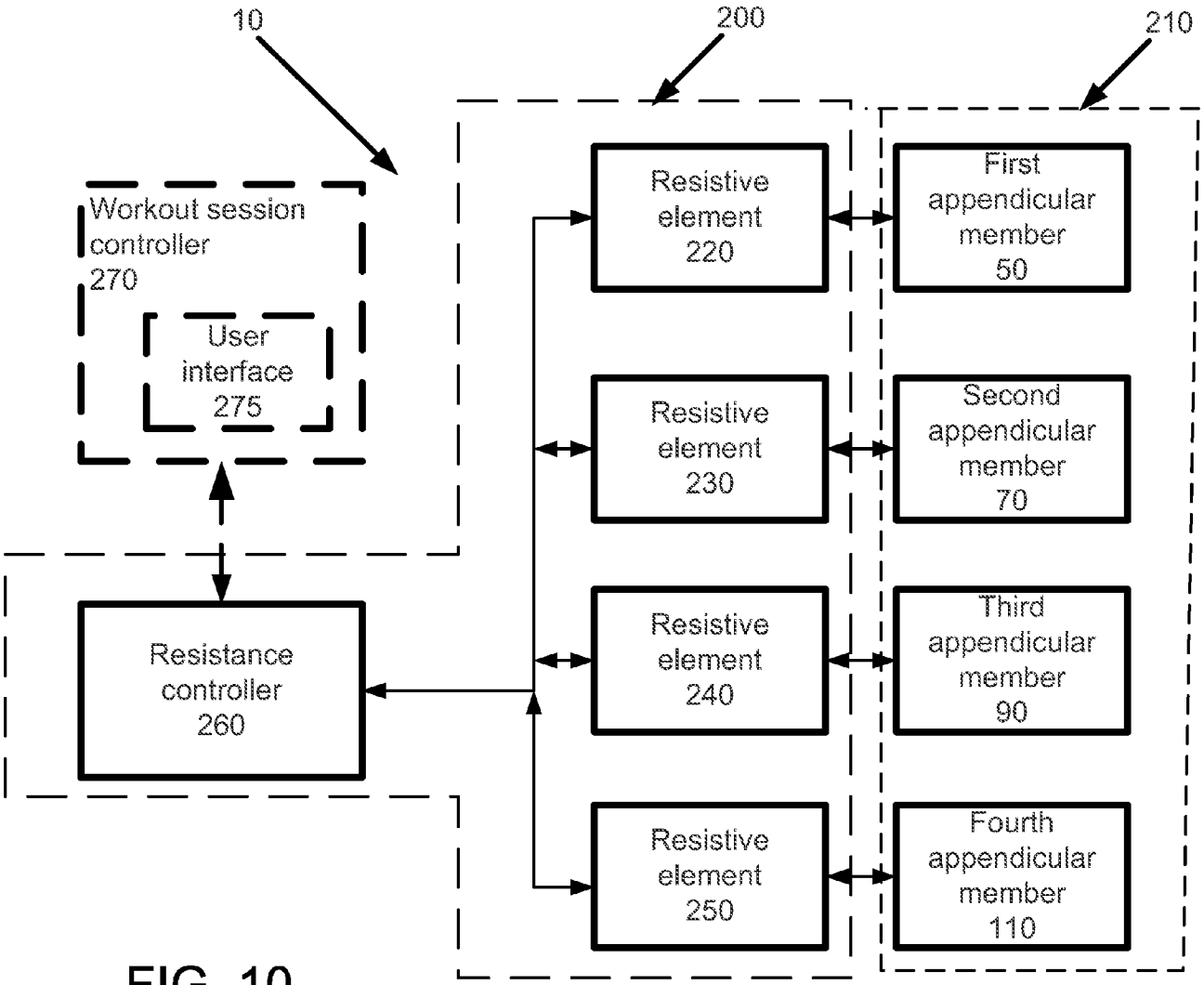
FIG. 10 is a schematic block diagram of a system that may be used to independently control the resistive force experienced by a user on each of the plurality of appendicular members.

FIG. 10 is a schematic block diagram of the full-body exercise apparatus 10 showing a resistive system 200 that may be used to independently control the resistive force provided on each of the plurality of appendicular members in its respective degree of freedom. The resistive system 200 may adjust the resistive forces in a generally continuous manner. In this example, a set of appendicular members 210 includes first appendicular member 50, second appendicular member 70, third appendicular member 90, and fourth appendicular member 110. Resistive element 220 is connected so as to apply a resistive force to the first appendicular member 50. Resistive element 230 is connected so as to apply a resistive force to the second appendicular member 70. Resistive element 240 is connected so as to apply a resistive force to the third appendicular member 90. Resistive element 250 is connected so as to apply a resistive force to the fourth appendicular member 110. One or more of the resistive elements 220, 230, 240, and 250 may be consolidated with one another so long as they are connected to apply independently controllable resistive forces to the appendicular members 50, 70, 90, and 110.

The resistive elements 220, 230, 240, and 250 may include any one of a variety of variable resistance structures. For example, one or more of the resistive elements 220, 230, 240, and 250 may be in the form of hydraulic and/or pneumatic actuators. Additionally, or in the alternative, the resistive elements may include one or more smart fluid-based actuators that, for example, are respectively associated with one or more of the plurality of appendicular members 50, 70, 90, and 110. In one example, the smart fluid-based actuators may include a smart-fluid selected from an electro-rheological fluid or a magneto-rheological fluid. Such smart fluid-based actuators may be used for resistive elements 220 and 230 to control the resistive forces experienced by the upper body of the user at the first appendicular member 50 and second appendicular member 70. Likewise, such smart fluid-based actuators may be used for resistive elements 240 and 250 to control the resistive forces experienced by lower body of the user at the third appendicular member 90 and fourth appendicular member 110. In one example, as will be explained below, resistive elements 240 and 250 may share common elements but, nevertheless, independently control the resistive forces experienced by the lower body of the user.

A resistance controller 260 may provide control signals to the resistive elements 220, 230, 240, and 250. The resistance controller 260 may send individual control signals to each of the resistive elements to set the resistive force applied by the resistive elements to their respective appendicular members. The control signals may be in an analog and/or digital format. For example, the control signals may be provided in the form of a current. Adjustable currents are particularly well suited when the resistive element is in the form of a smart-fluid actuator and/or a regenerative motor. Differing electric current magnitudes may be used to control the resistive force provided on each of the plurality of appendicular members so that each appendicular member has a different resistive force. The control signals may also be in a digital format, in which case the digital data transmitted to each resistive element may be converted in-situ and one or more of the plurality of appendicular members to an analog signal.

Optionally, the full-body exercise apparatus 10 may include a workout session controller 270 that is in communication with the resistance controller 260. In turn, the workout session controller 270 may include a user interface 275 used to allow user entry of a pre-programmed or customized workout session. The resistance controller 260 directs the resistive elements 220, 230, 240, and 250 to apply their respective resistive forces in accordance with the pre-programmed or customized workout session selected by the user.

Positional information for the third and fourth appendicular members 90 and 110 may be derived from a number of different sensor types that may be disposed at one or more locations. For example, the positions of the sliding members 140 and 145 may be detected using one or more magnetic or optical sensors 455. Additionally, or in the alternative, the positions of the third appendicular member 90 and fourth appendicular member 110 may be sensed by placing respective rheostats 460 and 465 in positions to co-rotate with cross-rods 330 and 335.

Figure 11:
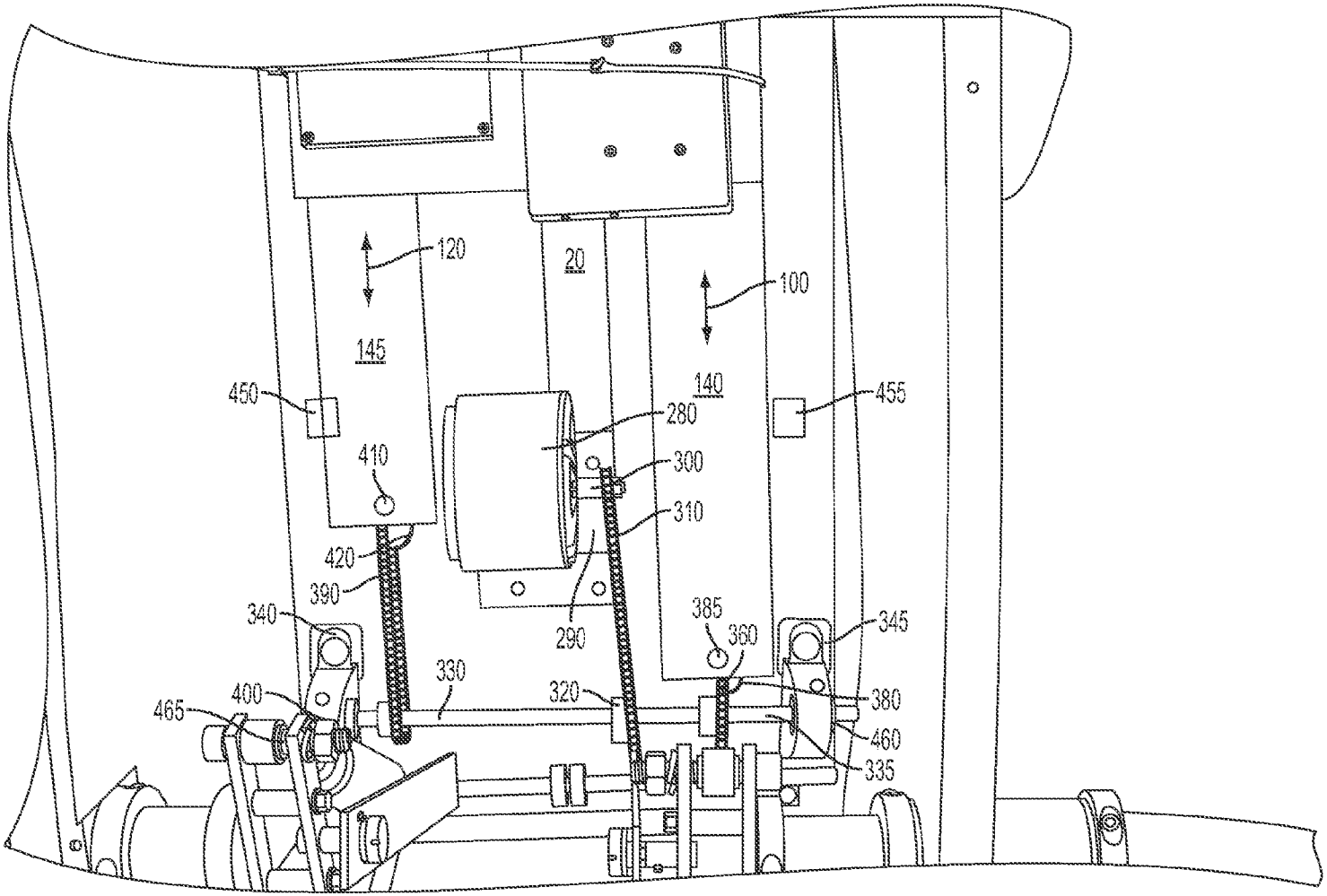
FIG. 11 shows one example of the resistance members and corresponding motion feedback associated with the third and fourth appendicular members.

FIG. 11 shows one manner in which the resistive elements 240 and 250 may be configured to allow independent movement of the third and fourth appendicular members 90 and 110 while sharing various components. Here, the resistive element is a regenerative motor 280 that is responsive to current signals provided by the resistance controller 260 to adjust its resistive torque. As shown, the regenerative motor 280 is secured to a base plate 290 of the frame 20. The shaft 300 of the regenerative motor 280 engages a transmission member 310, which, in turn, engages a single direction clutch 320 disposed on cross-rods 330 and 335. The cross-rods 330 and 335 collectively extend between a pair of anchor bearings 340 and 350 in a direction transverse to axes 100 and 120.

A transmission member 360 extends about gear mechanism 370 and engages the sliding member 140 at a first end 385 and a spring bias member at a second end 380. As such, the sliding member 140 is biased toward a rear position, corresponding to the position of the third and fourth appendicular members shown in FIG. 7 above.

A further transmission member 390 extends about gear mechanism 400 and engages the sliding member 145 at a first end 410 and a spring bias member at a second end 420. Again, the sliding member 145, like the sliding member 140, is biased toward a rear position. With this configuration, the amount of force needed to extend a given sliding member forward is dependent on the resistive force provided by the regenerative motor 280.

Each of the transmission members 360 and 390 are associated with motion of the corresponding appendicular members. In this example, drive chains are used for the transmission members 310, 360, and 390, although other types of transmission members, such as a timing belt, may be used.

Figure 12:
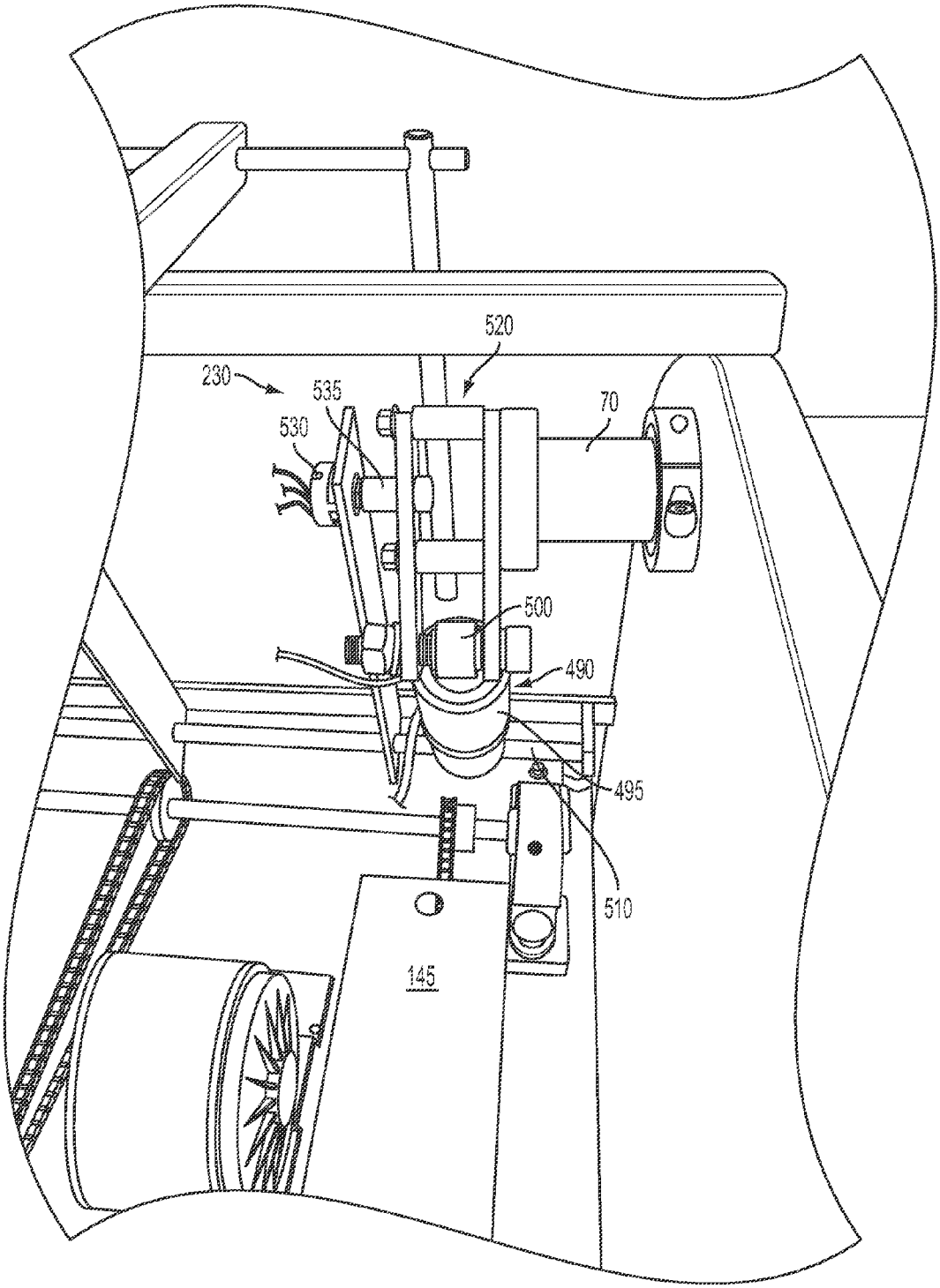
FIGS. 12 and 13 show examples of the resistance members and motion feedback sensors associated with the first and second appendicular members.
Figure 13:
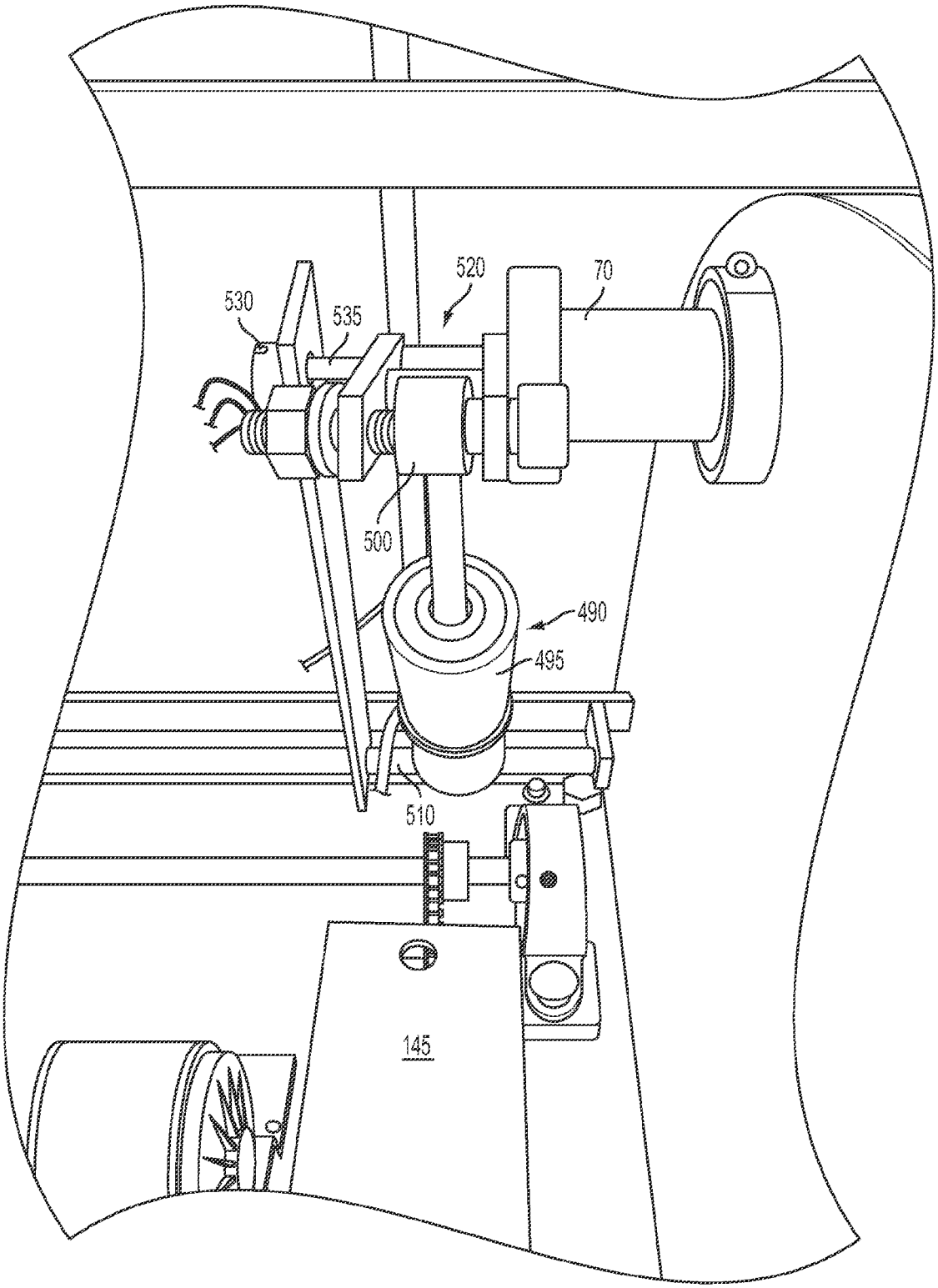

FIGS. 12 and 13 show one manner in which the resistive elements 220 and 230 may be implemented. To reduce repetition, only resistive element 230 is discussed.

In the example shown in FIG. 12, resistive element 230 includes a smart fluid-based actuator 490, which uses a smart-fluid selected from an electro-rheological fluid or a magneto-rheological fluid. The actuator 490 includes a cylinder 495 and a piston 500 disposed within the cylinder 495. A first end of the cylinder 495 is fixed to a cross-rod 510. Opposite the cross-rod 510, the piston 500 engages linkage 520, which extends between the piston 500 and the second appendicular member 70. Rotation of the second appendicular member 70 results in a corresponding linear translation of the piston 500 through the cylinder 495. As such, the actuator 490 controls the resistive force applied to the second appendicular member 70. A rheostat 530 is connected to a rotating shaft 535 of linkage 520 to determine the angular position of the second appendicular member 70. In FIG. 12, the second appendicular member 70 is in the position shown in FIG. 4. In FIG. 13, the second appendicular member 70 is in the position shown in FIG. 3. A similar arrangement may be used to implement resistive element 220 associated with the first appendicular member 50.

Position information for each of the first, second, third, and fourth appendicular members 50, 70, 90, and 110, is detected by at least one sensor. The sensor(s) may be used to feedback the position of the respective appendicular member for use in connection with the workout session controller 270. If the position information is detected over time, the velocity associated with the respective appendicular member may be determined. Further, if the information is determined over time, the acceleration associated with the respective appendicular member may also be determined.

Figure 14:
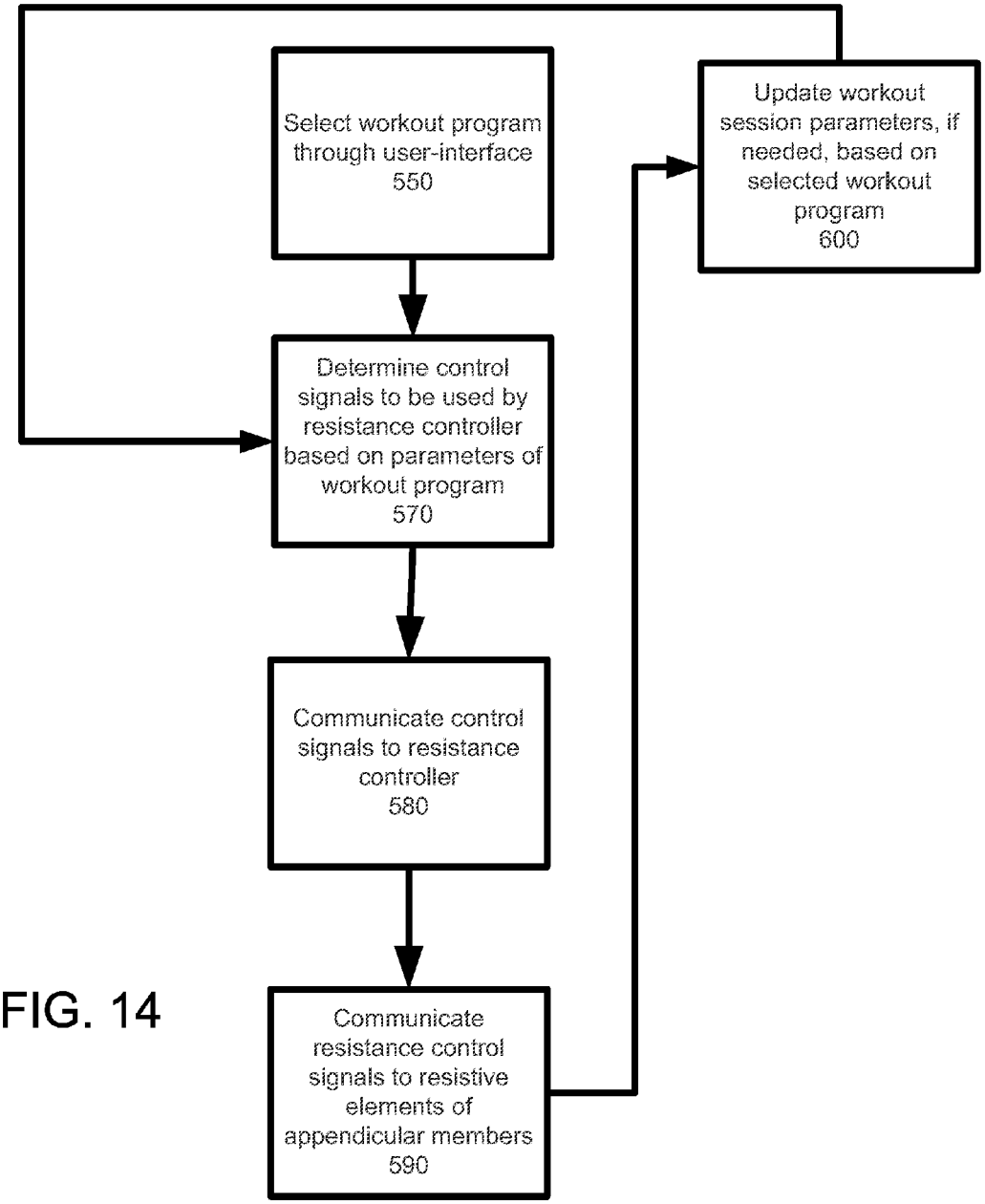
FIG. 14 illustrates operations that may be executed in the example of the system shown in FIG. 10.

FIG. 14 illustrates operations that may be executed by the exemplary system shown in FIG. 10. At operation 550, the user selects a workout program through the user interface, which is then communicated to the workout session controller at operation 560. The control signals to be used by the resistance controller are determined at operation 570 based on parameters of the selected workout program. At operation of 580, the control signals are communicated to the resistance controller, which, in turn, communicates resistance control signals corresponding to the control signals received at operation 580 to signals corresponding to the control signals received from the workout session controller. These control signals are sent to the resistive elements associated with the individual appendicular members at operation 590. The workout session controller updates the session parameters, if needed, based on the selected workout program at operation 600. These updates are provided to, or calculated by, the workout session controller at operation 570.

Figure 15:
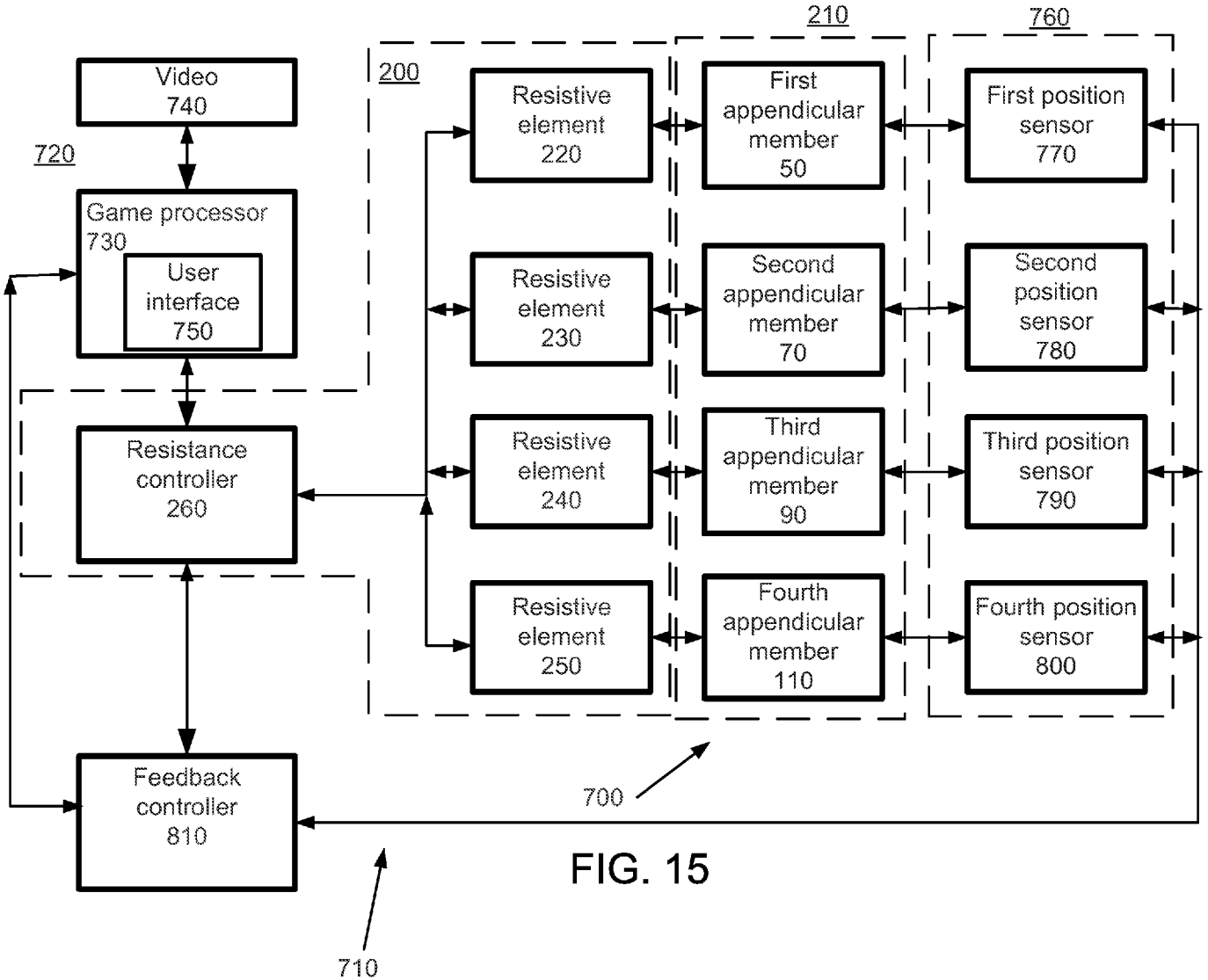
FIG. 15 shows one manner in which the full-body exercise apparatus may be used as a game controller in a workout game system.

FIG. 15 shows one manner in which the full-body exercise apparatus 10 may be used as a full-body game controller 700 in an electronic video game workout system 710. Here, the electronic video game workout system 710 includes a game system 720, which, in turn, includes a game processor 730 and a video display 740. The game processor 730 is configured to control game play of the electronic video game workout system 710. Game play is shown to the user on, for example, video display 740. The game processor 730 may also include a user interface 750, which may be used to select a particular game for play, adjust the skill and/or physical level of the game, etc. These game play attributes/parameters may be stored and/or accessed from local and/or remote memory storage.

Given that the full-body game controller 700 includes the appendicular members 210, it also includes its corresponding attributes. In this regard, the full-body game controller 700 includes a plurality of independently operable appendicular members configured for engagement with respective limbs of the user. Each of the plurality of appendicular members is movable in a degree of freedom independent of the other ones of the plurality of appendicular members. Since the full-body game controller of FIG. 15 is used as part of the video game, it includes components that place it in electronic communication with the game processor 730 for game play. In the example of FIG. 15, a plurality of sensors 760 (i.e., position sensors, pressure sensors, force sensors, accelerometers, velocity sensors, etc.) are associated with each of the appendicular members. Here, the sensors are in the form of position sensors respectively associated with each of the appendicular members. To this end, the first appendicular member 50 is associated with a first position sensor 770. The second appendicular member 70 is associated with a second position sensor 780. The third appendicular member 90 is associated with a third position sensor 790. The fourth appendicular member 110 is associated with a fourth position sensor 800. The sensor(s) may be used to feedback the position of the respective appendicular member for use in connection with game play of the video game. If the position information is detected over time, the velocity associated with the respective appendicular member may be determined. Further, if the information is determined over time, the acceleration associated with the respective appendicular member may also be determined.

The position sensing signals are provided from the sensors 760 to a feedback controller 810. The feedback controller 810, in turn, may provide corresponding signals to the game processor 730 where they are correlated with game rules to execute game play.

The electronic video game workout system 710 also includes a resistance controller 260, which is in electronic communication with the game processor 730. The game processor 730 provides resistance signals to the resistance controller 260 pursuant to executing game play. The resistance game play signals are used by the resistance controller 260 to individually control the resistive force provided by the resistive elements 220, 230, 240, and 250 to the respective appendicular members 50, 70, 90, and 110. As in FIG. 10, the resistance controller 260 controls resistive forces by providing control signals to the resistive elements 220, 230, 240, and 250. The control signals from the resistance controller 260 may be in the form of individual control signals to each of the resistive elements to set the resistive force applied by the resistive elements to their respective appendicular members. The control signals provided to the resistive elements may be in an analog and/or digital format. For example, the control signals may be provided in the form of a current. Adjustable currents are particularly well suited when the resistive element is in the form of a smart-fluid actuator and/or a regenerative motor. Differing electric current magnitudes may be used to control the resistive force provided on each of the plurality of appendicular members so that each appendicular member has a different resistive force. The control signals may also be in a digital format, in which case the digital data transmitted to each resistive element may be converted in-situ at one or more of the plurality of appendicular members to an analog signal.

Figure 16:
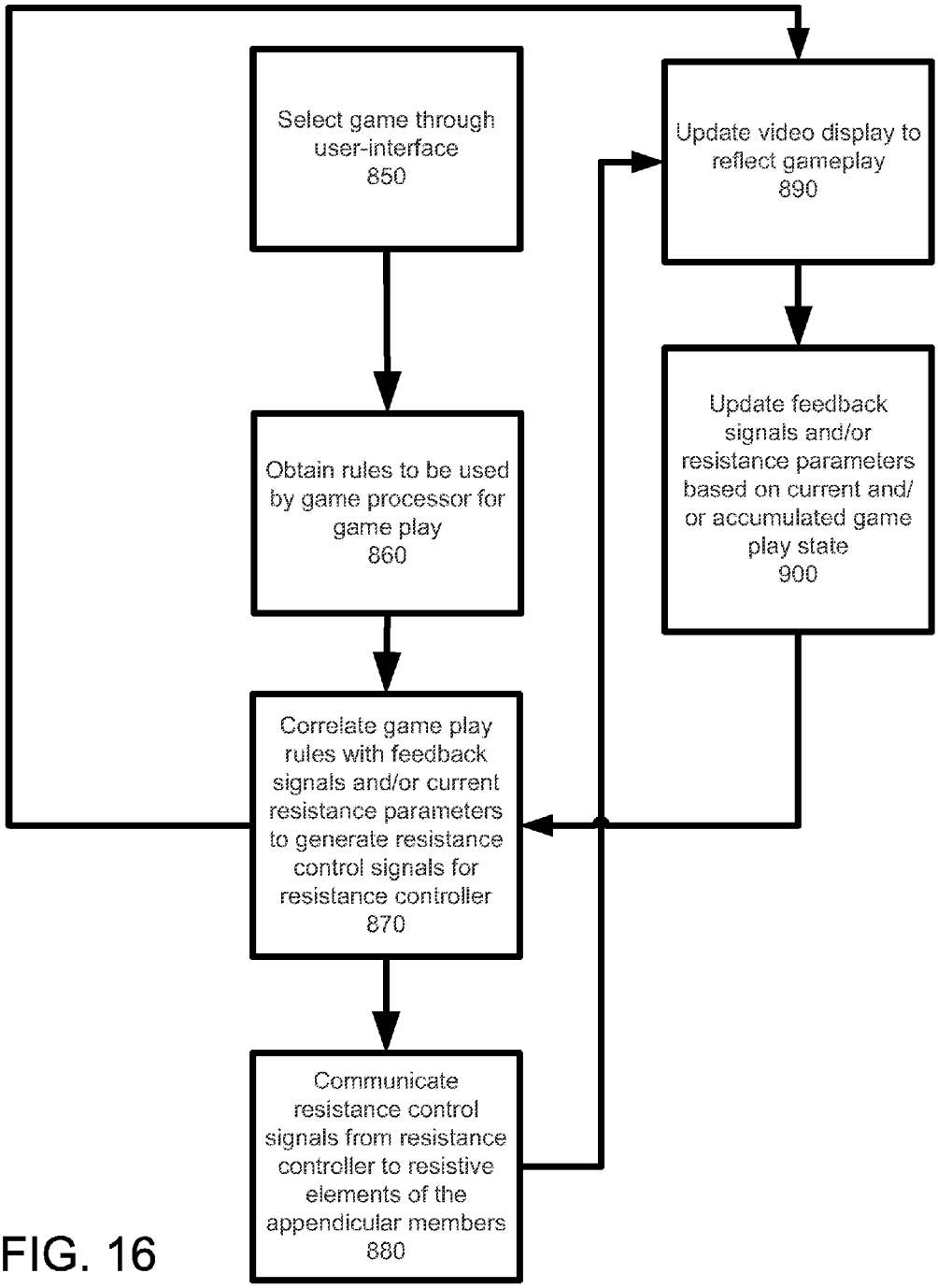
FIG. 16 shows one manner in which the exemplary system of FIG. 15 may be operated.

FIG. 16 shows one manner in which the exemplary system of FIG. 15 may be operated. In FIG. 16, the user selects the game that is to be executed through the user interface at operation 850. The rules to be used by the game controller for executing game play are attained at operation 860. During game play at operation 870, the signals from the feedback controller and/or contemporaneous resistance parameters may be correlated with game play rules to generate updated resistance control signals that are communicated to the resistance controller. For example, if a game character and/or icon of the video game encounters an obstacle, the signals provided to the game controller may be applied to the game play rules and used to update the resistive forces experience by one or more of the appendicular members. The game rules may also include increasing and/or decreasing the resistance experienced by one or more appendicular members when the game character exerts and/or refrains from a particular physical action in the video game (i.e., jumping, running, exhaustion from extended running or other activity, sword fighting, etc.)

In other instances, the resistive elements may be configured to apply a constant resistive force to the appendicular members. Such constant resistive force(s) may be used, for example, when the appendicular members are used by the video game to independently control movement of the game character/icon along various motion axes of the video game. One example of an existing game that may be controlled in this manner is Asteroids®.

At operation 880, the resistive control signals are communicated by the resistance controller to the resistive elements of the appendicular members, and the video display is updated to reflect changes in the game play at operation 890. At operation 900, the feedback signals and/or resistance parameters are updated based on current and/or accumulated game play states. These updated signals are returned to operation 870 for correlation with the game play rules.

While the present disclosure has been shown and described with reference to various examples, it will be understood that various changes in form and details may be made without departing from the spirit and scope of the present disclosure as defined by the appended claims.

The invention claimed is:

1. A game system comprising:

a game processor configured to control game play of an electronic video game; and a full-body game controller in electronic communication with the game processor, the full-body game controller having a plurality of independently operable appendicular members configured for engagement with respective limbs of a user, and wherein each of the plurality of appendicular members is movable in a degree of freedom independent of the other ones of the plurality of appendicular members, the plurality of independently operable appendicular members including:

a first appendicular member extending from a frame and configured to engage a first arm of a user, the first appendicular member being movable about a first pivot axis;

a second appendicular member extending from the frame and configured to engage a second arm of the user, the second appendicular member being movable about a second pivot axis;

a third appendicular member extending from the frame and configured to engage a first leg of the user, the third appendicular member being movable along a first generally linear axis; and a fourth appendicular member extending from the frame and configured to engage a second leg of the user, the fourth appendicular member being movable along a second generally linear axis.

2. The game system of claim 1, further comprising a resistance control system providing a resistive force on each of the plurality of appendicular members with respect to movement of the legs and arms of the user, wherein the resistive force provided by the resistance control system is adjustable in a generally continuous manner in response to game play of the electronic video game as determined by the game processor.

3. The game system of claim 2, further comprising a feedback control system responsive to at least one of a motion parameter, a force parameter, and/or a position parameter of each of the plurality of appendicular members to the game processor for control of the game play of the electronic video game.

4. The game system of claim 3, wherein the resistance control system is responsive to one or more signals corresponding to resistance control signals generated by the game processor.

5. The game system of claim 4, wherein the game processor obtains game rules to be used by the game processor to execute game play of the electronic video game.

6. The game system of claim 5, wherein the game processor correlates game play rules with feedback signals of the feedback control system and/or contemporaneous resistance parameters of the resistance control system to generate resistance control signals to the resistance control system.

7. A game system comprising:

a game processor configured to control game play of an electronic video game;

a game controller in electronic communication with the game processor, the game controller comprising:

a plurality of appendicular members configured for respective engagement with legs and arms of a user, the plurality of appendicular members including:

a first appendicular member configured to engage a first arm of a user for rotation about a first fixed pivot axis;

a second appendicular member configured to engage a second arm of the user for rotation about a second fixed pivot axis;

a third appendicular member configured to engage a first leg of the user for linear movement along a first fixed generally linear axis; and a fourth appendicular member configured to engage a second leg of the user for linear movement along a second fixed generally linear axis;

a resistance control system providing a resistive force on each of the plurality of appendicular members with respect to movement of the legs and arms of the user, wherein the resistive force provided by the resistance control system is adjustable in a generally continuous manner in response to the game play of the electronic video game; and a feedback control system responsive to at least one of a motion parameter, a force parameter, and/or a position parameter of each of the plurality of appendicular members to control the game play of the electronic video game.

8. The game system of claim 7, wherein the game processor obtains game rules to be used by the game processor to execute game play of the electronic video game.

9. The game system of claim 8, wherein the game processor correlates game play rules with feedback signals of the feedback control system and/or contemporaneous resistance parameters of the resistance control system to generate resistance control signals to the resistance control system.

10. The game system of claim 7, wherein the resistance control system is responsive to one or more signals corresponding to resistance control signals generated by the game processor.

11. The game system of claim 7, wherein the first fixed pivot axis and the second fixed pivot axis are generally collinear.

12. The game system of claim 7, wherein the first fixed linear axis and second fixed generally linear axis are generally parallel with one another.

13. The game system of claim 7, wherein the resistance control system comprises one or more smart fluid-based actuators respectively associated with one or more of the plurality of appendicular members, wherein the one or more smart fluid-based actuators are responsive to an electric current for resistance control, and wherein the electric current corresponds to resistance control signals generated by the resistance control system in response to the game processor.

14. The game system of claim 13, wherein the one or more smart fluid-based actuators comprise a smart fluid selected from an electro-rheological fluid or a magneto-rheological fluid.

15. The game system of claim 7, wherein the resistive control system comprises:

a first smart fluid-based actuator respectively associated with a first appendicular member to control resistance to movement of the first appendicular member by a first arm of a user; and a second smart fluid-based actuator respectively associated with a second appendicular member to control resistance to movement of the second appendicular member by a second arm of the user.

16. A game controller for use in controlling operation of electronic video game system comprising:

a frame;

a plurality of appendicular members extending from the frame and configured for respective engagement with legs and arms of a user;

each of the plurality of appendicular members being further configured for engagement with at least one resistive member of a resistance control system for independent control of resistive forces experienced by the plurality of appendicular members the plurality of appendicular members including:

a first appendicular member extending from a frame and configured to engage a first arm of a user, the first appendicular member being movable about a first pivot axis;

a second appendicular member extending from the frame and configured to engage a second arm of the user, the second appendicular member being movable about a second pivot axis;

a third appendicular member extending from the frame and configured to engage a first leg of the user, the third appendicular member being movable along a first generally linear axis; and a fourth appendicular member extending from the frame and configured to engage a second leg of the user, the fourth appendicular member being movable along a second generally linear axis.

* * * * *